US006736936B1

(12) United States Patent
Weston et al.

(10) Patent No.: US 6,736,936 B1
(45) Date of Patent: May 18, 2004

(54) COATING COLOR

(75) Inventors: Philip Mark Weston, West Yorkshire (GB); Robert Cockcroft, West Yorkshire (GB)

(73) Assignee: Ciba Specialty Chemicals Water Treatments Ltd., Bradford West (GB)

( * ) Notice: Subject to any disclaimer, the term of this patent is extended or adjusted under 35 U.S.C. 154(b) by 0 days.

(21) Appl. No.: 10/030,534

(22) PCT Filed: Jul. 17, 2000

(86) PCT No.: PCT/EP00/06790

§ 371 (c)(1),
(2), (4) Date: Jan. 9, 2002

(87) PCT Pub. No.: WO01/07714

PCT Pub. Date: Feb. 1, 2001

(30) Foreign Application Priority Data

Jul. 27, 1999 (GB) ..... 9917508

(51) Int. Cl.[7] ..... D21H 19/36; D21H 19/56; C08L 33/26

(52) U.S. Cl. ..... 162/135; 162/168.3; 162/184; 106/214.2; 106/217.6; 106/217.9; 106/287.25

(58) Field of Search ..... 162/135–137, 162/158, 162, 164, 164.6, 168.1, 168.2, 168.3, 175, 181.1, 181.2, 181.8, 184; 106/145.1, 147.1, 155.21, 157.71, 162.51, 155.1, 214.1, 214.2, 217.6, 257.8, 287.25, 464, 481, 712; 428/500, 511–513, 523, 340–342, 206–209; 524/515, 521, 529, 522, 543, 904, 555, 922, 728, 804; 525/329.4

(56) References Cited

U.S. PATENT DOCUMENTS

| | | | | | |
|---|---|---|---|---|---|
| 2,661,309 | A | * | 12/1953 | Azorlosa | 428/454 |
| 2,945,775 | A | * | 7/1960 | Lehman et al. | 162/135 |
| 3,937,633 | A | | 2/1976 | Knight et al. | 106/90 |
| 4,115,339 | A | | 9/1978 | Restaino | 260/29.6 |
| 4,115,340 | A | * | 9/1978 | Ellwanger | 523/336 |
| 4,236,545 | A | * | 12/1980 | Knight et al. | 137/13 |
| 4,307,215 | A | * | 12/1981 | Goretta et al. | 526/213 |
| 4,395,524 | A | * | 7/1983 | Emmons et al. | 526/307.2 |
| 4,423,118 | A | | 12/1983 | Corbett et al. | 428/514 |
| 4,652,471 | A | | 3/1987 | van Rooden et al. | 524/521 |
| 4,673,716 | A | * | 6/1987 | Siano et al. | 525/367 |
| 5,215,668 | A | * | 6/1993 | Bhattacharyya et al. | 210/712 |
| 5,270,103 | A | * | 12/1993 | Oliver et al. | 428/219 |
| 6,034,181 | A | * | 3/2000 | Bazaj et al. | 525/218 |

FOREIGN PATENT DOCUMENTS

| | | |
|---|---|---|
| CA | 1 163 395 | 3/1984 |
| EP | 024 602 | 8/1980 |

* cited by examiner

*Primary Examiner*—Peter Chin
*Assistant Examiner*—Eric Hug
(74) *Attorney, Agent, or Firm*—Kevin T. Mansfield

(57) ABSTRACT

A coating color composition comprising an aqueous dispersion of (a) a pigment, (b) a binder, (c) a fluorescent whitener and (d) a water-soluble polymer formed from a water-soluble ethylenically unsaturated monomer or monomer blend, characterised in that the water-soluble polymer consists essentially of, (i) 90 to 100 mole % hydrophilic essentially nonionic repeating units and, (ii) 0 to 10 mole % anionic repeating units and has an average molecular weight of between 50,000 and 500,000.

7 Claims, No Drawings

COATING COLOR

This invention relates to pigment coating compositions useful in preparing coated paper, board and other cellulosic materials, particularly rheologically enhanced coating compositions. The invention also relates to coated articles prepared from said coating compositions and further relates to novel polymers which may be used in said coating compositions.

It is known to apply pigment coating compositions to the surface of formed paper or board, for instance to improve the printability, gloss and optical characteristics. This pigment coating composition is known as coating colour. Typically a coating colour is applied as an aqueous dispersion comprising a blend of pigment(s) with binder.

Generally a coating colour composition comprises one or more pigments, a fluorescent whitening agent (FWA), a binder, a rheology modification agent and optionally other chemical agents. The pigment is usually a white inorganic particulate material, for instance calcium carbonate or kaolin, and normally comprises at least 75%, often at least 85% by weight of the dispersed solids in the coating colour composition. Fluorescent whitening agents (FWA), also known as optical brightening agents (OBA) enhance the light reflectance qualities, thus improving the whiteness and brightness of the coated sheet. Binder is present to affix the pigment to the coated paper or board sheet and is normally an adhesive polymeric material. The binder may be an aqueous latex comprising dispersed particles of water insoluble adhesive polymer. Alternatively the binder may be an aqueous composition, comprising water soluble starch. It is also possible that the binder comprises both aqueous latex polymer and starch. The rheology of the coating colour composition is normally adjusted to suit the specific application.

Typically a coating colour composition is applied to the surface of the paper or board sheet by means of a coating applicator, which may be a bar or a blade. Blade coaters are popular because they can coat at speeds exceeding 1,200 m/min (3,930 ft/min) and use coating solids up to 70%. In addition, the blade creates an even distribution of coating over the surface of the paper or board sheet and excess coating is removed to leave a smooth flat coated surface. It is important that the coating has a smooth flat surface in order to improve printability.

It is normally necessary to adjust the rheology to within quite narrow parameters in order to attain the most appropriate rheology for application. Since the application of the coating colour composition normally involves exposing it to high shear, it important that the coated composition exhibits the correct flow properties and water retention properties. For this reason it is standard practice to incorporate rheology modifiers into the coating colour composition. The water retention capability of a coating colour composition relates to the ability of the composition to hold the water. The release of water into the paper or board sheet must be relatively slow in order for the surface of the coating to be smoothed. Rapid penetration of the water into paper or board sheet would result in excessive amounts of water being removed from the coating prior to reaching the blade, which would impair the ability of the blade to adequately smooth the coating. Additionally, the excessive release of the water into the sheet can lead to an unequal distribution of binder, often known as binder migration. Typically the binder migration occurs through the z-direction of the coating. The consequence of binder migration is an impairment of the surface properties.

Various polymeric materials have been used for the purpose of improving the rheology and water retention characteristics of coating colour compositions and coatings therefrom. It is well known to apply natural polymers such as sodium carboxymethyl cellulose, hydroxyethyl cellulose, methyl cellulose and sodium alginate. In addition various synthetic polymers including polyvinyl alcohol and acrylic polymers have also been proposed for this purpose. For instance U.S. Pat. No. 4,423,118 describes a coating colour composition comprising as a thickener a copolymer of an ethylenically unsaturated carboxylic acid, an ethylenically unsaturated amide and a hydrophobic monomer having limited solubility in water. The preferred copolymers comprise between 30 and 97 weight % acrylic acid, 1 to 50 weight % acrylamide and 2 to 70 weight % acrylonitrile.

In achieving optimum flow and water retention characteristics for a coating colour composition, the coated paper or board sheet can suffer the disadvantage of impaired optical properties. It would thus be desirable to provide a coating colour composition that still exhibits optimum rheological properties, with a high degree of water retention and yet the coated paper or paper board sheet has improved optical properties.

According to the invention a coating colour composition is provided, comprising an aqueous dispersion of, (a) a pigment, (b) a binder, (c) a fluorescent whitening agent and (d) a water-soluble polymer formed from a water-soluble ethylenically unsaturated monomer or monomer blend, characterised in that the water-soluble polymer consists essentially of, (i) 90 to 100 mole % hydrophilic essentially nonionic repeating units and, (ii) 0 to 10 mole % anionic repeating units and has an average molecular weight of between 50,000 and 500,000.

The pigments may be an inorganic material such as calcium carbonate, kaolin clay, aluminium or magnesium silicates, such as china clay, barium sulphate, satin white, titanium dioxide, talcum, gypsum and muscovite mica. Alternatively the pigment may be a polymeric plastic pigment comprising microspheres, for instance 0.1–1.0 $\mu$m diameter, that are either hollow or solid. Such polymeric plastic pigments may be based on polystyrene, with the polymer sometimes having butadiene or acrylic components. Preferably however, the pigment is an inorganic compound, more preferably calcium carbonate or clays such as kaolin or blends of calcium carbonate with clay. The choice of pigment or blend of pigments is usually determined by the particular application. For instance the pigment component single coatings for low coat weight (LWC) papers may consist solely of clay. It may also be desirable to apply multiple layers of coating to the surface of paper or board. The first coatings (pre-coat) may desirably consist of 100% calcium carbonate as the pigment component, whereas for the top coats it may be desirable to use blends of calcium carbonate and clay as the pigment component. The pigment is normally provided as an aqueous dispersion of usually at least 40 or 50% solids. Preferably the pigment dispersion is at least 60 or 70% solids and can be up to 80%. A particularly preferred pigment dispersion comprises between 70 and 72% calcium carbonate.

In order to assist the stability of the pigment dispersion it is sometimes desirable to include a dispersant. The dispersant can be for instance a surfactant although more preferably the dispersant is a polymeric dispersant, for instance a relatively low molecular weight water-soluble anionic polymer. Particularly preferred are sodium polyacrylates of molecular weight in the range 1,000 to 6,000 for instance as described in EP-B-129329.

The pigment would normally constitute at least 75% by weight, for instance at least 85 or 90% by weight of the total solids present in coating colour composition.

The binder may be for instance an aqueous latex polymer dispersion based on copolymers of butadiene/styrene, acrylonitrile/butadiene/styrene, acrylic acid esters, acrylic acid and esters/styrene/acrylonitrile, ethylene/vinyl chloride, and ethylene/vinyl acetate; or homopolymers, such as polyvinyl chloride, polyvinylidene chloride, polyethylene and polyvinyl acetate or polyurethanes. The binder dispersions may be prepared by aqueous emulsion polymerisation. Preferred binders consist of styrene/butyl acrylate or styrene/butadiene/acrylic acid copolymers or styrene/butadiene rubbers. Other polymer latexes which may be used in the invention are described, for example in U.S. Pat. Nos. 3,265,654, 3,657,174, 3,547,899 and 3,240,740. Typically the dispersions comprise particles within the size range of 0.05 to 2 microns and a binder content of 40 to 55% by weight.

The fluorescent whitening agent (FWA) may be any chemical with the fluorescent ability to take in light from the ultraviolet part of the light spectrum and emit it in the visible spectrum. Preferably the fluorescent whiteners are stilbene fluorescent whitening agents, such as described in GB-A-2026566 and GB-A-2026054 or bis-stilbene fluorescent whitening agents, as described in EP-A-624687. The fluorescent whitening agent includes diaminostilbene disulphonic acid derivatives and distyryl biphenyl derivatives. Preferably the fluorescent whitening agents are provided in the form of an aqueous concentrated slurry, usually at least 30% by weight, for instance about 60% by weight.

The coating colour composition according to the present invention preferably contains 10 to 70% by weight of the pigment. The binder is preferably used in an amount which is sufficient to make the dry content of the polymeric compound between 1 and 30% by weight, preferably 5 to 25% by weight, more preferably 7 a to 20% by weight of the pigment. The amount of fluorescent whitening agent used according to the invention is calculated so that the fluorescent whitening agent is preferably present in amounts of 0.01 to 1% by weight, more preferably 0.05 to 1% by weight based on weight of pigment. The rheology modifier is preferably used in an amount of 0.01 to 5% by weight, preferably 0.05 to 2% by weight, more preferably 0.1 to 2% by weight of pigment. The aqueous dispersion may comprise between 50 and 80% solids based on total weight of dispersion, although preferably the dispersions are about 70% solids.

A preferred way of preparing the coating colour composition according to the invention is by combining aqueous binder emulsion and the aqueous pigment dispersion in amounts to provide the appropriate proportions of pigment and binder and then adding the aqueous dispersion of fluorescent whitening agent under vigorous stirring in order to ensure that pigment, binder and fluorescent whitening agent particles are evenly distributed throughout the aqueous medium. It may be necessary then to add more water in order to obtain the correct solids content. Preferably the water soluble polymer (component (d)) is added to the aqueous dispersion once the other components have been mixed sufficiently to ensure an even distribution of the other components and where necessary additional water has been added. However, it is possible to mix the components together differently. For instance the fluorescent whitener formulation may be incorporated into the binders, for instance, by means of melt emulsification.

The coating colour composition according to the invention shows optimum rheological properties, including good water retention properties, and provides a coated paper or board sheet with improved optical properties, in particular improved brightness and whiteness. It is a surprising feature of the invention that these improvements are as a consequence of employing the polymer (component (d)) which has the special combination of features of 1) consisting essentially of 90 to 100 mole % hydrophilic essentially nonionic repeating units and 0 to 10 mole % anionic repeating units and 2) a molecular weight within the specific range of 50,000 and 500,000.

The water soluble polymer, component (d), according to the invention is performing as a rheology modifier or water retention aid in the coating colour composition. However, it is clear that the polymer is also improving the optical properties of the coated paper or board and so should not be regarded solely as a rheology modifier. In effect the water soluble polymer (component (d)) may be regarded as also functioning as an adjuvant in improving the optical properties.

The water soluble polymer according to the invention is formed from a water soluble monomer or monomer blend. Desirably the water solubility of the monomer or monomers is/are above 5 g/100 ml, although preferably at least 10 g/100 ml. The monomer or monomer blend should contain substantially no water insoluble monomers as this would detract from the performance of the coating colour composition.

The water soluble polymer component according to the invention consists essentially of 90 to 100 mole %, hydrophilic essentially nonionic repeating units and 0 to 10 mole %, anionic repeating units. The polymer may be derived from a blend of water soluble nonionic ethylenically unsaturated monomer with water soluble anionic ethylenically unsaturated monomer. Alternatively the anionic repeating units may be generated by post reacting repeating units which are capable of being converted into anionic groups. For instance repeating units containing a pendant amide group can be hydrolysed by the action of an alkali to generate the corresponding carboxylic acid.

The water-soluble polymer is preferably provided as an aqueous solution, for instance between 10 and 25%, most preferably 15 to 20% concentration. The polymer can be formed by any suitable polymerisation technique, such as gel, bead, reverse phase emulsion polymerisation or preferably solution polymerisation. Thus the polymers can be provided in the form of powder, beads, aqueous solution, reverse phase emulsion or as a dehydrated reverse phase emulsion (liquid dispersion polymer).

The hydrophilic essentially nonionic repeating units of the water soluble polymer component are preferably derived from water-soluble monomer or blend of monomers selected from the group consisting of acrylamide, methacrylamide, N-vinyl pyrrolidone, N-vinyl caprolactam, hydroxyethyl acrylate and hydroxyethyl methacrylate.

Desirably the anionic repeating units of the water soluble polymer component are derived from water-soluble anionic monomer or blend of monomers selected from the group consisting of acrylic acid, methacrylic acid, maleic acid, itaconic acid, crotonic acid, 2-acrylamido-2-methylpropane sulphonic acid, allyl sulphonic acid and vinyl sulphonic acid. The anionic monomer(s) may be present in the form of the free acid or water soluble alkali metal or ammonium salt.

In a preferred form, the water-soluble polymer component of the coating colour composition consists essentially of, (i) 90 to 99.5, more preferably 92.5 to 99 mole % hydrophilic essentially nonionic repeating units, and (ii) 0.5 to 10, more preferably 1 to 7.5 mole % anionic repeating units.

It has been found that the performance of the coating colour composition is further enhanced when the water soluble polymer component comprises between 2.5 and and 5 mole % anionic repeating units. Thus in a particulary preferred form the coating colour composition according to the invention comprises a water soluble polymer consisting essentially of, (i) 95 to 97.5 mole % hydrophilic essentially nonionic repeating units, and (ii) 2.5 to 5 mole % anionic repeating units.

Preferably the water soluble polymer component of the coating colour composition has an average molecular weight between 50,000 and 300,000, more preferably between 100,000 and 250,000, in particular in the range 150,000 to 250,000, especially 180,000 to 230,000, most preferably around 200,000.

Another aspect of the invention relates to a cellulosic article coated with the coating colour composition comprising an aqueous dispersion of, (a) a pigment, (b) a binder, (c) a fluorescent whitening agent and (d) a water-soluble polymer formed from a water-soluble ethylenically unsaturated monomer or monomer blend, characterised in that the water-soluble polymer consists essentially of, (i) 90 to 100 mole % hydrophilic essentially nonionic repeating units and, (ii) 0 to 10 mole % anionic repeating units and has an average molecular weight of between 50,000 and 500,000.

The coated cellulosic article according to the invention includes any of the preferred embodiments described herein. The coated cellulosic article according to this aspect of the invention combines improved printability, gloss, brightness and whiteness characteristics. Preferably the coated cellulosic article is a coated paper or coated board.

Typically the coated cellulosic article may be provided by passing the un-coated article over a coating application from which the coating colour can be applied. The coating is allowed to dry, optionally by the use of heated air dryers. Where desired several layers of coating may be applied to the article. In a preferred form where the coated cellulosic article is a coated paper or coated board the un-coated sheet of paper or board may be passed over the coating applicator, which may be a coating bar or blade, from which the coating colour composition is applied to the surface of the paper or board. Desirably the coating on the paper or board is dried by use of heated air dryers. An additional coating layer may then be desirably applied to the un-coated surface of the paper or board. It may also be desirable to apply several coatings to the surface(s) of the paper or board to form a multilayer coating. It may also be desirable to polish the coating, for instance by use of a callendering device. Typically the coated sheet of paper or board is passed between two rollers, one of which is designed to slip against the coated surface to be polished. This slipping effect is designed to provide a highly polished surface to the coated sheet.

In a further aspect of the invention the polymer component of the colour coating composition is a novel compound. Thus this aspect of the invention is directed to a water-soluble polymer formed from a water-soluble ethylenically unsaturated monomer or monomer blend, characterised in that the water-soluble polymer consists essentially of, (i) 90 to 99.5 mole % hydrophilic essentially nonionic repeating units, and (ii) 0.5 to 10 mole % anionic repeating units, and has an average molecular weight of between 50,000 and 500,000. In addition all of the preferred forms of the polymer component of the coating colour composition are also specifically incorporated into this aspect of the invention.

The water-soluble polymer is preferably provided as an aqueous solution, for instance between 10 and 25%, most preferably 15 to 20% concentration. The polymer can be formed by any suitable polymersation technique, such as gel, bead or solution polymerisation. However, polymerisation of an aqueous solution of the monomer or monomer blend may be the most convenient technique since it avoids an additional dissolution step that would otherwise be required to provide the polymer at the correct concentration for the application. Thus the aqueous solution of water-soluble polymer may be provided conveniently by adding an aqueous solution of initiators, for instance ammonium persulphate, to a 15 to 20% aqueous solution of the monomer or monomer blend whilst stirring to ensure adequate distribution of the initiators and polymerising material and allowing the polymerisation to proceed.

The following examples illustrate the invention.

EXAMPLE 1

Preparation of Polymer A

A monomer blend is prepared comprising 720 Kg acrylamide and 18 Kg acrylic acid dissolved in 735 Kg of water. 2300 Kg water is charged to a reactor and to this is added 0.12 Kg ammonium persulphate dissolved in 6 Kg water and the mixture is stirred well. The monomer blend is added to the reactor over 1.5 hours whilst stirring is maintained in the reactor. Simultaneous with commencing the monomer addition 1.41 Kg ammonium persulphate dissolved in 150 Kg water is added to the reactor over 2 hours. On completion of the polymerisation the pH of the resultant aqueous polymer solution is adjusted using 46% sodium hydroxide solution.

Preparation of Polymer B

The process described for the preparation of polymer is A is repeated except using 702 Kg acrylamide and 36 Kg acrylic acid.

Characterisation of Polymer Components Used in Colour Coating Preparation

Polymers A and B are copolymers of acrylamide with sodium acryate as given in the preparations above. Polymer C is a copolymer of acrylamide with ammonium acrylate and Polymer D is a copolymer of 50 weight % ethyl acrylate and 50 weight % methacrylic acid prepared as an aqueous emulsion and then dissolved in aqueous sodium hydroxide to saponify the ester groups. The polymer characteristics are summarised in Table 1.

TABLE 1

| Polymer | Composition (Mole %) AA | ACM | EA | MAA | Polymer conc. (Wt %) | Av Mol. Wt. |
|---|---|---|---|---|---|---|
| A | 2.5 as Na salt | 97.5 | | | 19.8 | 216,000 |
| B | 5 as Na salt | 95 | | | 19.6 | 242,000 |
| C | 20 as $NH_3$ salt | 80 | | | 16 | 450,000 |
| D | — | — | 46.2 | 53.8 | 30 | 250,000 |

Key
AA Acrylic Acid
ACM Acrylamine
EA Ethyl Acrylate
MAA Methacrylic Acid

EXAMPLE 2

Preparation and Testing of Colour Coating Composition

| Formulation 1 | Amount by wt. |
|---|---|
| Calcium carbonate (particle size 95% below 2 microns) | 50 parts |
| Kaolin (particle size 90% below 2 microns) | 50 parts |
| Styrene butadiene latex polymer (Dow DL 935) | 10 parts |
| Fluorescent whitening agent (diamino stilbene hexasulfonic acid Tinopal SPP) | 1 part |

The coating colour composition is prepared by mixing together the kaolin and calcium carbontate as aqueous dispersions. The styrene/butadiene latex polymer is then mixed in with the pigment dispersion and to this is added 1 part of the fluorescent whitening agent, diamino stilbene hexasulfonic acid (Tinopal SPP available from Ciba Specialty Chemicals).

Four samples of the dispersion are taken and to each polymers A to D are added at a dose to give a Brookfield Viscosity of between 1800 to 2000 mPa.s. The samples of coating colour formulation has 62% solids and a pH of 8.2.

The optimum dose for each polymer is shown in Table 2.

TABLE 2

| Polymer | Dose (wt % based on pigment) |
|---|---|
| A | 0.80 |
| B | 1.00 |
| C | 1.00 |
| D | 0.35 |

Water Retention GWR (gsm)

The water retention values GWR are measured in gsm on a Gravimetric water retention meter, using the parameters of 2 minutes dwell time, 1.5 bar pressure and 5 $\mu$m polycarbonate membrane filters. The measurements are shown for each sample comprising polymers A to D. The water retention measurements are shown in Table 3.

TABLE 3

| Polymer | Water Retention GWR (gsm) |
|---|---|
| A | 130 |
| B | 110 |
| C | 130 |
| D | 144 |

High Shear Viscosity

High shear viscosity is measured in mPa.s on an ICI cone and plate viscometer at $1000s^{-1}$. The viscosity measurements for each sample comprising polymers A to D are shown in Table 4.

TABLE 4

| Polymer | High Shear Viscosity (mPa · s) @ 10000 $s^{-1}$ |
|---|---|
| A | 220 |
| B | 145 |
| C | 105 |
| D | 60 |

Optical Performance

The samples of coating colour formulation comprising polymers A to D respectively are coated onto paper using k-bar 3 to provide a coat weight of 20 $g/m^2$ and the brightness and whiteness are measured on a Technibrite ERIC 950. The brightness and whiteness measurements are shown in table 5.

TABLE 5

| Polymer | ISO Brightness (%) | CIE Whiteness (%) |
|---|---|---|
| A | 81.65 | 74.24 |
| B | 81.35 | 72.7 |
| C | 81.0 | 72.65 |
| D | 79.98 | 71.0 |

EXAMPLE 3

Preparation and Testing of Colour Coating Composition

| Formulation 2 | Amount by wt. |
|---|---|
| Calcium carbonate (particle size 75% below 2 microns) | 100 parts |
| Styrene acrylic latex polymer | 11 parts |
| Fluorescent whitening agent diamino stilbene tetrasulfonic acid | 1 part |

The coating colour according to formulation 2 is prepared by mixing the respective components together in an analogous way to the preparation shown in Example 2.

Four samples of the dispersion are taken and to each polymers A to D are added at a dose that will give a to give a Brookfield viscosity of between 1100 to 1400 mPa.s. The samples of coating colour formulation has 70% solids and a pH of 9.0. The optimum dose for each polymer is shown in Table 6.

TABLE 6

| Polymer | Dose (wt % based on pigment) |
|---|---|
| A | 0.65 |
| B | 0.41 |
| C | 0.32 |
| D | 0.15 |

Water Retention GWR (gsm)

The water retention values GWR are measured as in Example 2. The water retention measurements are shown in Table 7.

TABLE 7

| Polymer | Water Retention GWR (gsm) |
|---|---|
| A | 180 |
| B | 190 |
| C | 200 |
| D | 191 |

High Shear Viscosity

High shear viscosity is measured as shown in Example 2. The high shear viscosity measurements are shown in Table 8.

TABLE 8

| Polymer | High Shear Viscosity (mPa · s) @ 10000 $s^{-1}$ |
|---|---|
| A | 80 |
| B | 65 |
| C | 75 |
| D | 80 |

Optical Performance

The samples of coating colour formulation comprising polymers A to D respectively are coated onto paper and optical brightness and whiteness measured as given in Example 2. The measurements are shown in table 9.

TABLE 9

| Polymer | ISO Brightness (%) | CIE Whiteness (%) |
|---|---|---|
| A | 86.7 | 82.75 |
| B | 86.2 | 81.35 |
| C | 85.9 | 80.65 |
| D | 83.38 | 77.40 |

EXAMPLE 4

Preparation and Testing of Colour Coating Composition

| Formulation 3 | Amount by wt. |
|---|---|
| Calcium carbonate (particle size 99% below 2 microns) | 20 parts |
| Kaolin | 80 parts |

-continued

| Formulation 3 | Amount by wt. |
|---|---|
| Styrene butadiene acrylonitrile latex polymer | 12 parts |
| Fluorescent whitening agent diamino stilbene hexasulphonic acid (Tinopal SPP) | 1 part |

The coating colour according to formulation 3 is prepared by mixing the respective components together in an analogous way to the preparation shown in Example 2.

Four samples of the dispersion are taken and to each polymers A to D are added at a dose that will give a to give a Brookfield viscosity of between 1800 to 2000 mPa.s. The samples of coating colour formulation has 61.6% solids and a pH of 7.5.

The optimum dose for each polymer is shown in Table 10.

TABLE 10

| Polymer | Dose (wt % based on pigment) |
|---|---|
| A | 0.43 |
| B | 0.48 |
| C | 0.35 |
| D | 0.225 |

Water Retention GWR (gsm)

The water retention values GWR are measured as in Example 2. The water retention measurements are shown in Table 11.

TABLE 11

| Polymer | Water Retention GWR (gsm) |
|---|---|
| A | 130 |
| B | 110 |
| C | 130 |
| D | 120 |

High Shear Viscosity

High shear viscosity is measured as shown in Example 2. The high shear viscosity measurements are shown in Table 12.

TABLE 12

| Polymer | High Shear Viscosity (mPa · s) @ 10000 $s^{-1}$ |
|---|---|
| A | 435 |
| B | 250 |
| C | 100 |
| D | 135 |

Optical Performance

The samples of coating colour formulation comprising polymers A to D respectively are coated onto paper and optical brightness and whiteness measured as given in Example 2. The measurements are shown in table 13.

TABLE 13

| Polymer | ISO Brightness (%) | CIE Whiteness (%) |
|---|---|---|
| A | 80.5 | 77.7 |
| B | 79.88 | 77 |
| C | 79.28 | 76.7 |
| D | 77.90 | 74.4 |

The results clearly show that polymers A and B provide the best all round performance in terms of rheology and brightness for different coating colour formulations comprising different pigment types.

What is claimed is:

1. A coating colour composition comprising an aqueous dispersion of, (a) a pigment, (b) a binder, (c) a fluorescent whitener and (d) a water-soluble polymer formed from a water-soluble ethylenically unsaturated monomers, characterised in that the water-soluble polymer consists essentially of, (i) 90 to 99.5 mole % hydrophilic essentially nonionic repeating units derived from acrylamide and methacrylamide and, (ii) 0.5 to 10 mole % anionic repeating units and has an average molecular weight of between 50,000 and 500,000.

2. A coating colour composition according to claim 1 in which the water-soluble polymer comprises anionic repeating units which are derived from water-soluble anionic monomer selected from the group consisting of acrylic acid, methacrylic acid, maleic acid, itaconic acid, crotonic acid, 2-acrylamido-2-methylpropane sulphonic acid, allyl sulphonic acid and vinyl sulphonic acid and wherein the monomer is in the form of the free acid or water soluble alkali metal or ammonium salt.

3. A coating colour composition according to claim 1 in which the water soluble polymer consists essentially of, (i) 92.5 to 99 mole % hydrophilic essentially nonionic repeating units, and (ii) 1 to 7.5 mole % anionic repeating units.

4. A coating colour composition according to claim 1 in which the water soluble polymer consists essentially of, (i) 95 to 97.5 mole % hydrophilic essentially nonionic repeating units, and (ii) 2.5 to 5 mole % anionic repeating units.

5. A coating colour composition according to claim 1 in which the water-soluble polymer has an average molecular weight between 50,000 and 300,000.

6. A coating colour composition according to claim 1 in which the water-soluble polymer has an average molecular weight between 100,000 and 250,000.

7. A cellulosic article which has been coated with the coating colour composition as defined by claim 1.

* * * * *